US005983404A

United States Patent [19]

Jackson

[11] Patent Number: 5,983,404

[45] Date of Patent: Nov. 16, 1999

[54] MATERNITY UNDERGARMENT AND METHOD OF USE

[76] Inventor: Rosezina Jackson, 2770 NW. 174th St., Miami, Fla. 33056

[21] Appl. No.: 08/956,671

[22] Filed: Oct. 23, 1997

[51] Int. Cl.[6] ..... A41D 9/00

[52] U.S. Cl. ..... 2/406; 2/400; 2/403; 450/151; 450/155

[58] Field of Search ..... 2/67, 69, 69.5, 2/75, 80, 83, 400, 401, 402, 403, 406, 408; 450/155, 151

[56] References Cited

U.S. PATENT DOCUMENTS

| | | | |
|---|---|---|---|
| Re. 20,567 | 12/1937 | Bachelis | 2/67 |
| 2,513,039 | 6/1950 | Miller | 2/406 |
| 2,921,583 | 1/1960 | Lerner | 2/402 |
| 4,122,552 | 10/1978 | Tedford | 2/70 |
| 4,494,546 | 1/1985 | Steiman | 2/67 |
| 4,698,855 | 10/1987 | Hicks | 2/402 |
| 4,937,887 | 7/1990 | Schreiner | 2/402 |
| 5,546,608 | 8/1996 | Russano | 2/408 |

*Primary Examiner*—Gloria Hale
*Attorney, Agent, or Firm*—Frank L. Kubler

[57] ABSTRACT

A garment for giving front abdominal support during the advanced stages of pregnancy includes a sheet of flexible sheet material having first opposing side edges, the first opposing side edges having opposing leg opening forming notches, defining on one side of the opposing notches a garment front panel and on the other side of the opposing notches a garment rear panel, and defining between the opposing notches a panel interconnection section; the front panel having a support section including support material for supporting the wearer abdominal area; the first opposing side edges including a releasible fastener for interconnecting and for disconnecting the garment front panel and garment rear panel. The garment additionally includes an abdomen support strap extending laterally across and secured to the front panel. A method is provided of placing the above-described garment on a wearer in an advanced stage of pregnancy, including the steps of placing the sheet between the legs of the wearer so that the notches register with and receive the wearer legs; pivoting the front panel upwardly and against the front of the wearer torso and pivoting the rear panel upwardly and against the rear of the wearer torso; bringing the first side edges on the front panel and the first side edges on the rear panel toward each other; and releasibly interconnecting the front panel and rear panel first side edges by fastening the fasteners.

11 Claims, 2 Drawing Sheets

MATERNITY UNDERGARMENT AND METHOD OF USE

BACKGROUND OF THE INVENTION

1. Field of the Invention

The present invention relates generally to the field of maternity clothing and undergarments. More specifically the present invention relates to a maternity undergarment in the form of a brief or panty which provides abdominal support and is put on and taken off with ease. The inventive undergarment includes a rectangular sheet of light-weight flexible fabric having longitudinal side edges with opposing leg opening forming notches. The opposing notches separate the sheet into two portions, defining at one end of the sheet a garment front panel and at the other end a garment rear panel, and defining between the notches an interconnection section. The front panel includes material forming a support section which, for one embodiment, is highly elastic and resilient, and for another embodiment is heavy and stiff relative to the sheet fabric. The front panel also includes a laterally extending abdomen support strap. The longitudinal side edges, with the exception of the notches, and the support strap ends, include releasible fastening means for interconnecting and for disconnecting the front and rear panels.

To put on the garment, the fastening means are released and the front and rear panels are pivoted away from each other about the interconnection section. Then the sheet is placed between the legs of the wearer so that the notches register with and receive the wearer legs. Then the front and rear panels are pivoted upwardly and against the wearer abdomen and posterior, respectively. The longitudinal side edges are brought together and the fastening means are fastened. This garment structure and method eliminate the need for pulling the supportive front panel and strap upwardly against and slidingly over the protruding abdomen.

2. Description of the Prior Art

There have long been undergarments which are assembled by the wearer from a foldable sheet of flexible material and releasibly fastened into a garment configuration.

Tedford, U.S. Pat. No 4,122,552, issued on Oct. 31, 1978, teaches a disposable undergarment. Tedford includes a rectangular sheet of flexible material having parabolic recesses midway along opposing longitudinal edges of the sheet. To either side of the recesses, the longitudinal edges include fastening strips with outer layers which peal away to expose bonding surfaces. To configure the sheet into an undergarment, the sheet is folded along a line extending between the opposing recesses, and the fastening strips are brought face to face together so that they interconnect. A problem with Tedford is that it does not provide the abdominal support needed during the advanced stages of pregnancy. There is no supportive front panel and no teaching of assembly of the garment around and against the abdomen during gestation.

Hicks, U.S. Pat. No. 4,698,855, issued on Oct. 13, 1987, reveals disposable panty. Hicks is very similar to Tedford, including a flexible and generally rectangular sheet of light disposable material. Rather than lateral recesses for forming leg openings, Hicks provides two laterally spaced apart elliptical leg ports. Rather than strip fasteners following longitudinal sheet edges, Hicks provides two strips of pressure sensitive adhesive tape extending perpendicular to and between adjacent longitudinal sheet edges brought together by the folding of the sheet. Since the tape strips extend between the edges, they permit attachment of the edges at any of various distances from each other so that one garment is adjustable to fit a variety of wearer waist sizes. Longitudinal pleats permit adjustment to fit various wearer leg diameters as well. The problems of Tedford are again presented, in addition to the need to stoop and pull the leg ports over the feet.

Russano, U.S. Pat. No. 5,546,608, issued on Aug. 20, 1996, discloses an undergarment for incontinent patients. Russano includes front and rear flexible panels for extending over the front and rear surfaces of a patient torso, respectively, top elastic panel interconnection means and a releasible opening flap at the crotch area. A central notch opening is provided at the crotch to pass a catheter. Russano is no better suited than Tedford to solving the support and garment fitting problems associated with pregnancy.

Schreiner, U.S. Pat. No. 4,937,887, issued on Jul. 3, 1990, discloses a garment with hook-and-loop fasteners. Schreiner includes a flexible sheet with leg recesses which is folded into a garment configuration and fastened, much like that of Tedford. Schreiner differs from Tedford in that the fasteners are laterally extending hook and loop fastener pads which meet and intermesh. When disassembled for laundering, the pads are separated from each other, and are then automatically retracted into pockets provided in the sheet by elastic ligaments, so that lint does not collect on the fastener pads and so that the pads do not damage other garments during laundering. The problems of providing support during pregnancy are not addressed by Schreiner.

It is thus an object of the present invention to provide a garment for use during the advanced stages of a pregnancy, which includes a front panel structured to lift and support the protruding abdominal area.

It is another object of the present invention to provide such a garment which permits direct placement of the front panel against the torso without need of pulling the front panel upwardly against, around and over the protruding abdomen and without the resulting discomfort and potential for injury.

It is still another object of the present invention to provide such a garment which eliminates the need to bend down and pull the garment over the wearer feet and legs to put on and take off the garment.

If is a further object of the present invention to achieve the above-recited objects synergistically by providing a garment structure combining a supportive front panel with a laterally separating rear panel which can be releasibly interconnected with highly secure fastener means along panel longitudinal side edges, so that the support section can be pivoted directly against the protruding abdomen.

It is finally an object of the present invention to provide such a garment which is comfortable, durable and inexpensive to manufacture.

SUMMARY OF THE INVENTION

The present invention accomplishes the above-stated objectives, as well as others, as may be determined by a fair reading and interpretation of the entire specification.

A garment is provided for giving front abdominal support during the advanced stages of pregnancy, including a sheet of flexible sheet material having first opposing side edges, the first opposing side edges having opposing leg opening forming notches, defining on one side of the opposing notches a garment front panel and on the other side of the opposing notches a garment rear panel, and defining between the opposing notches a panel interconnection section; the front panel having a support section including support material for supporting the wearer abdominal area; the first opposing side edges including a releasible fastener for interconnecting and for disconnecting the garment front panel and garment rear panel. The garment additionally includes an abdomen support strap extending laterally across and secured to the front panel. The fastener is preferably one of a zipper fastener and a snap fastener.

The sheet is preferably substantially rectangular, and preferably formed of relatively light-weight material. The support material is preferably flexible. The support material is optionally elastic and resilient, and alternatively is heavy and stiff relative to the sheet of material. The sheet material is optionally elastic. Where the sheet is substantially rectangular, and includes opposing second side edges, the sheet preferably further includes an elastic band extending along the second side edges to encircle and engage the waist of a wearer and additionally secure the garment around the wearer. The notches are preferably curved to substantially conform to the shape of the wearer legs for greater comfort.

A method is provided of placing the above-described garment on a wearer in an advanced stage of pregnancy, including the steps of placing the sheet between the legs of the wearer so that the notches register with and receive the wearer legs; pivoting the front panel upwardly and against the front of the wearer torso and pivoting the rear panel upwardly and against the rear of the wearer torso; bringing the first side edges on the front panel and the first side edges on the rear panel toward each other; and releasibly interconnecting the front panel and rear panel first side edges by fastening the fasteners.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
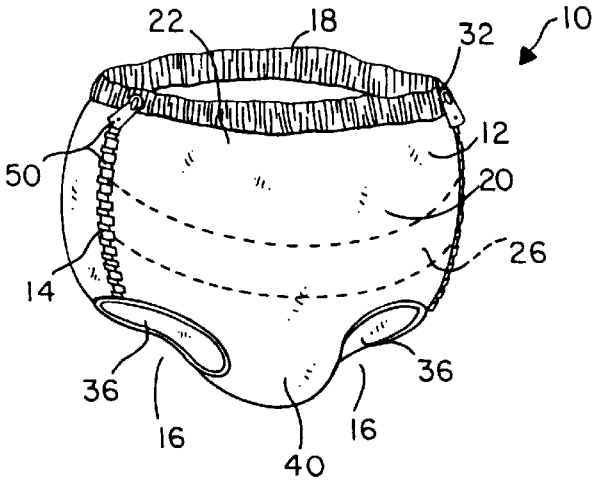
FIG. 1 is a perspective front view of the inventive garment assembled for wear, having the preferred zipper fastener.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figure 2:
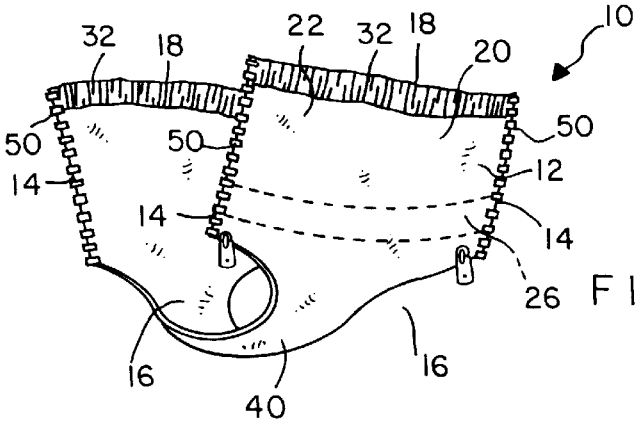
FIG. 2 is a view as in FIG. 1 with the zipper fasteners disconnected at the sheet longitudinal edges and with the front and rear panels partially pivoted apart.
Figure 3:
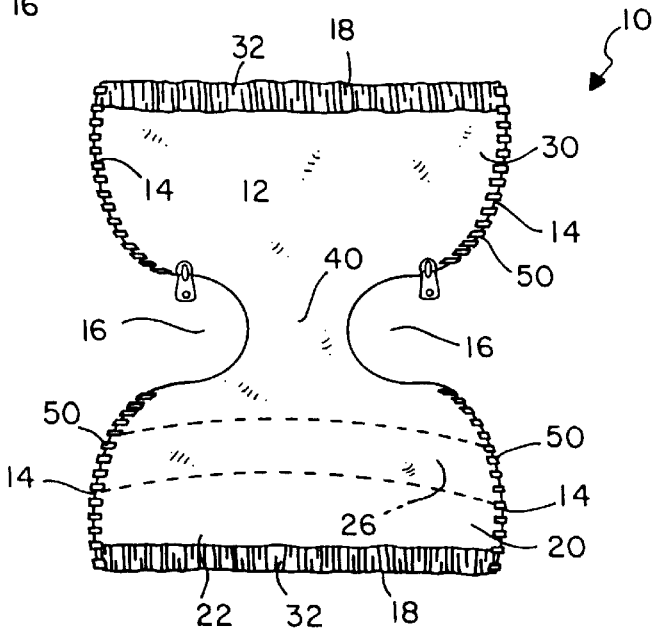
FIG. 3 is a view as in FIG. 2 with the front and rear panels pivoted fully apart so that the sheet is substantially planar, showing the preferred sheet configuration.
Figure 4:
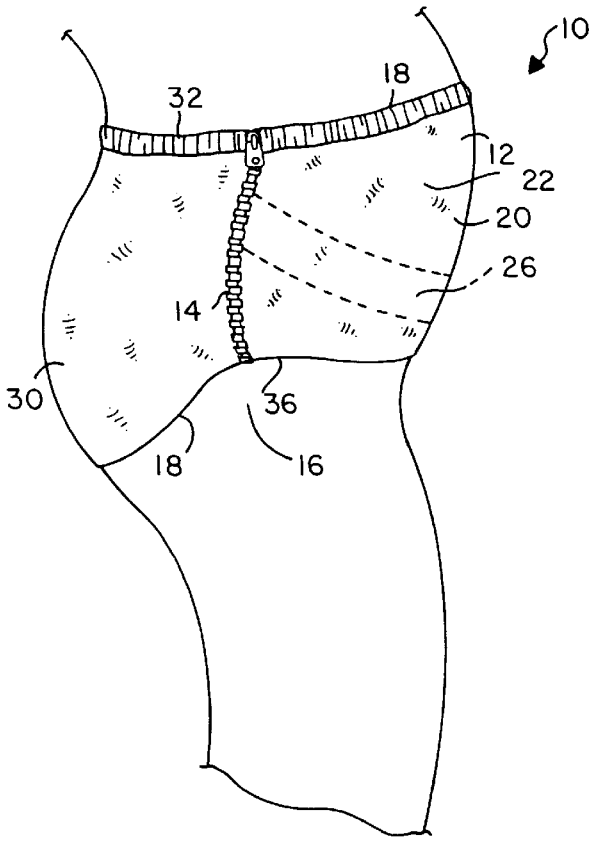
FIG. 4 is a side view of the assembled garment on a wearer.
Figure 5:
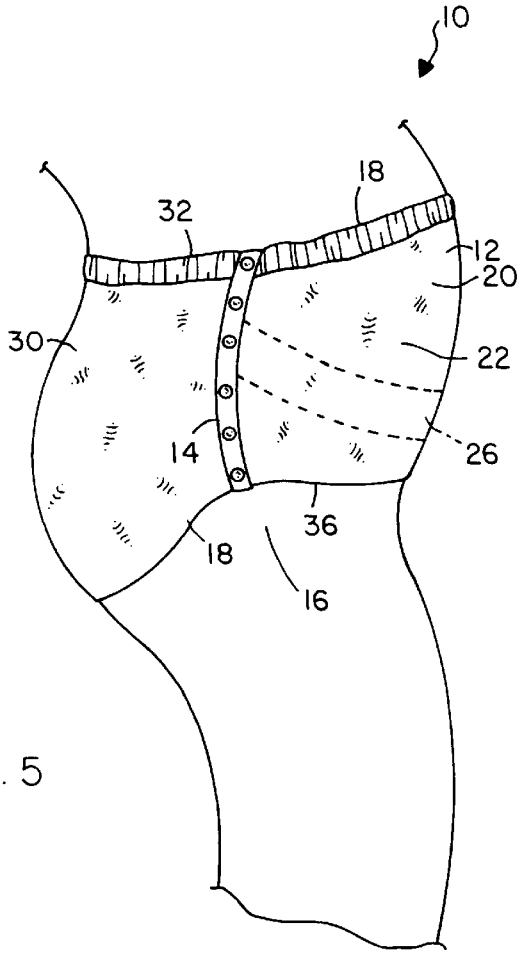
FIG. 5 is a side view as in FIG. 4, but showing the snap fastener alternative.

Referring to FIGS. 1–5, a maternity undergarment 10 in the form of a brief or panty is disclosed, including a generally rectangular sheet 12 of light-weight flexible fabric having longitudinal side edges 14 and lateral side edges 18. Longitudinal side edges 14 include centrally located opposing leg opening forming notches 16 defining on one side of the pair of notches 16 a garment front panel 20 and on the other side a garment rear panel 30, and defining between notches 16 an interconnection section 40. Front panel 20 includes support material 22 which is preferably flexible and, for one embodiment, is elastic and resilient, and for another embodiment is heavy and relatively stiff, defining a support section 24 for supporting the distended wearer abdomen. A laterally extending abdomen support strap 26 is also provided across front panel 20. Longitudinal side edges 14, with the exception of notches 16, include releasible fastening means 50 for interconnecting and for disconnecting front and rear garment panels, 20 and 30, respectively.

Fastening means 50 are preferably zipper fasteners, to provide sturdy abdominal support, buttons and button holes or heavy snap fasteners. Sheet 12 is preferably of a type of material conventionally used to make underwear, and may be elastic or simply have an elastic band across lateral side edges 18 to define an elastic top band 32 on garment 10. Leg notches 16 are preferably curved and parabolic to form substantially circular or elliptical leg openings 36 when front panel 20 and rear panel 30 are interconnected with fastening means 50. The support material 22 of support section 24 may be sewn onto front panel 20, and alternatively may be sewn into an opening within front panel 20. Strap 26 may be formed of leather or any other suitable material. Strap 26 is preferably connected to fastening means 50 and is preferably sewn onto the inner surface of the front panel 20, although it may alternatively be sewn to the outer surface or contained within a pocket in panel 20.

Method

In practicing the invention, the following method may be used. To put on garment 10, fastening means 50 are released, and front and rear panels 20 and 30 are pivoted away from each other. See FIG. 2. Then sheet 12 is fitted between the legs of the wearer and positioned so that notches 16 register with and receive the wearer legs. Then front and rear panels 20 and 30 are pivoted upwardly and against the wearer abdomen and posterior, respectively. Longitudinal side edges 14 are brought together, and fastening means 50 are fastened. See FIGS. 4 and 5.

The structure of garment 10 and the practicing of these steps permit placement of support section 24 and strap 26 within the front panel 20 directly against the abdomen, eliminating the need for pulling front panel 20 upwardly against and slidingly over the protruding abdomen. These structural and resulting procedural features additionally eliminate the need for the gestating wearer to strain through bending down to pull the garment around the feet and over the legs.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A garment for providing front abdominal support during advanced stages of pregnancy, comprising:

a sheet of flexible sheet material having first opposing side edges, said first opposing side edges having opposing leg opening forming notches, defining on one side of said opposing notches a garment front panel and on the other side of said opposing notches a garment rear panel, and defining between said opposing notches a panel interconnection section;

said first opposing side edges comprising releasible fastening means for interconnecting and for disconnecting said garment front panel and garment rear panel;

said front panel comprising an abdomen support strap extending laterally across and secured to said front panel.

2. The garment of claim 1, wherein said sheet is substantially rectangular.

3. The garment of claim 1, wherein said sheet is formed of relatively light-weight material.

4. The garment of claim 1, wherein said support material is flexible.

5. The garment of claim 1, wherein said support material is elastic and resilient.

6. The garment of claim 1, wherein said support material is heavy and stiff relative to said sheet of material.

7. The garment of claim 1, wherein said fastening means comprises one of a zipper fastener and a snap fastener.

8. The garment of claim 1, wherein said sheet material is elastic.

9. The garment of claim 1, wherein said sheet is substantially rectangular and comprises opposing second side edges and wherein said sheet further comprises an elastic band extending along said second side edges to encircle and engage the waist of a wearer and thereby additionally secure said garment around the wearer.

10. The garment of claim 1, wherein said notches are curved to substantially conform to the shape of the wearer legs.

11. A garment for providing front abdominal support during advanced stages of pregnancy, comprising:

a sheet of flexible sheet material having first opposing side edges, said first opposing side edges having opposing leg opening forming notches, defining on one side of said opposing notches a garment front panel and on the other side of said opposing notches a garment rear panel, and defining between said opposing notches a panel interconnection section;

said first opposing side edges comprising releasible fastening means for interconnecting and for disconnecting said garment front panel and garment rear panel;

said front panel comprising an abdomen support strap extending laterally across said front panel to said first opposing side edges and being engaged and secured by said releasible fastening means.

* * * * *